US005689843A

United States Patent [19]

Duke et al.

[11] Patent Number: 5,689,843

[45] Date of Patent: Nov. 25, 1997

[54] SHOWER WATER CONSERVATION SYSTEM

[76] Inventors: Rubin E. Duke; Margaret Duke, both of 304 Buckhorn Rd., Manford, Ala. 36268

[21] Appl. No.: 749,516

[22] Filed: Nov. 18, 1996

[51] Int. Cl.[6] ..... A47K 3/22

[52] U.S. Cl. ..... 4/675; 4/615; 4/678; 4/597; 251/295

[58] Field of Search ..... 4/675, 678, 596, 4/597, 603, 605, 615, 602, 599, 600; 251/295

[56] References Cited

U.S. PATENT DOCUMENTS

| | | | |
|---|---|---|---|
| 1,807,900 | 6/1931 | Dougherty | 4/615 |
| 2,042,278 | 5/1936 | Sloan | 251/295 |
| 3,292,185 | 12/1966 | Lucian | 4/615 |
| 4,729,135 | 3/1988 | Titterington | 4/615 |
| 4,934,000 | 6/1990 | Freedman | 4/615 |

FOREIGN PATENT DOCUMENTS

| | | | |
|---|---|---|---|
| 076717 | 4/1983 | European Pat. Off. | 4/600 |
| 391026 | 8/1908 | France | 4/596 |
| 1053053 | 1/1954 | France | 4/615 |

*Primary Examiner*—Henry J. Recla
*Assistant Examiner*—Charles R. Eloshway

[57] ABSTRACT

A new Shower Water Conservation System for conserving water during a shower thereby resulting in reduced water bills includes a T-spigot, a first flexible tube coupled to the T-spigot, a water control valve matingly coupled with the first flexible tube opposite of the T-spigot, a second flexible tube matingly coupled to the control valve, and a T-coupler matingly coupled to the second flexible tube and a shower head.

6 Claims, 3 Drawing Sheets

SHOWER WATER CONSERVATION SYSTEM

BACKGROUND OF THE INVENTION

1. Field of the Invention

The present invention relates to Water Control Devices and more particularly pertains to a new Shower Water Conservation System for conserving water during a shower thereby resulting in reduced water bills.

2. Description of the Prior Art

The use of Water Control Devices is known in the prior art. More specifically, Water Control Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Water Control Devices include U.S. Pat. No. 5,263,684; U.S. Pat. No. 5,386,600; U.S. Pat. De. 254,488; U.S. Pat. No. 5,199,119; U.S. Pat. No. 5,226,629 and U.S. Pat. No. 5,125,623.

While these devices fulfill their respective, particular objectives and requirements, the aforementioned patents do not disclose a new Shower Water Conservation System. The inventive device includes a T-spigot, a first flexible tube coupled to the T-spigot, a water control valve matingly coupled with the first flexible tube opposite of the T-spigot, a second flexible tube matingly coupled to the control valve, and a T-coupler matingly coupled to the second flexible tube and a shower head.

In these respects, the Shower Water Conservation System according to the present invention substantially departs from the conventional concepts and designs of the prior art, and in so doing provides an apparatus primarily developed for the purpose of conserving water during a shower thereby resulting in reduced water bills.

SUMMARY OF THE INVENTION

In view of the foregoing disadvantages inherent in the known types of Water Control Devices now present in the prior art, the present invention provides a new Shower Water Conservation System construction wherein the same can be utilized for conserving water during a shower thereby resulting in reduced water bills.

The general purpose of the present invention, which will be described subsequently in greater detail, is to provide a new Shower Water Conservation System apparatus and method which has many of the advantages of the Water Control Devices mentioned heretofore and many novel features that result in a new Shower Water Conservation System which is not anticipated, rendered obvious, suggested, or even implied by any of the prior art Water Control Devices, either alone or in any combination thereof.

To attain this, the present invention generally comprises a T-spigot, a first flexible tube coupled to the T-spigot, a water control valve matingly coupled with the first flexible tube opposite of the T-spigot, a second flexible tube matingly coupled to the control valve, and a T-coupler matingly coupled to the second flexible tube and a shower head.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application which is measured by the claims, nor is it intended to be limiting as to the scope of the invention in any way.

It is therefore an object of the present invention to provide a new Shower Water Conservation System apparatus and method which has many of the advantages of the Water Control Devices mentioned heretofore and many novel features that result in a new Shower Water Conservation System which is not anticipated, rendered obvious, suggested, or even implied by any of the prior art Water Control Devices, either alone or in any combination thereof.

It is another object of the present invention to provide a new Shower Water Conservation System which may be easily and efficiently manufactured and marketed.

It is a further object of the present invention to provide a new Shower Water Conservation System which is of a durable and reliable construction.

An even further object of the present invention is to provide a new Shower Water Conservation System which is susceptible of a low cost of manufacture with regard to both materials and labor, and which accordingly is then susceptible of low prices of sale to the consuming public, thereby making such Shower Water Conservation System economically available to the buying public.

Still yet another object of the present invention is to provide a new Shower Water Conservation System which provides in the apparatuses and methods of the prior art some of the advantages thereof, while simultaneously overcoming some of the disadvantages normally associated therewith.

Still another object of the present invention is to provide a new Shower Water Conservation System for conserving water during a shower thereby resulting in reduced water bills.

Yet another object of the present invention is to provide a new Shower Water Conservation System which includes a T-spigot, a first flexible tube coupled to the T-spigot, a water control valve matingly coupled with the first flexible tube opposite of the T-spigot, a second flexible tube matingly coupled to the control valve, and a T-coupler matingly coupled to the second flexible tube and a shower head.

Still yet another object of the present invention is to provide a new Shower Water Conservation System that is easily detachable from the spigot and shower head.

Even still another object of the present invention is to provide a new Shower Water Conservation System that allows the user to easily control the water pressure to the shower head.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
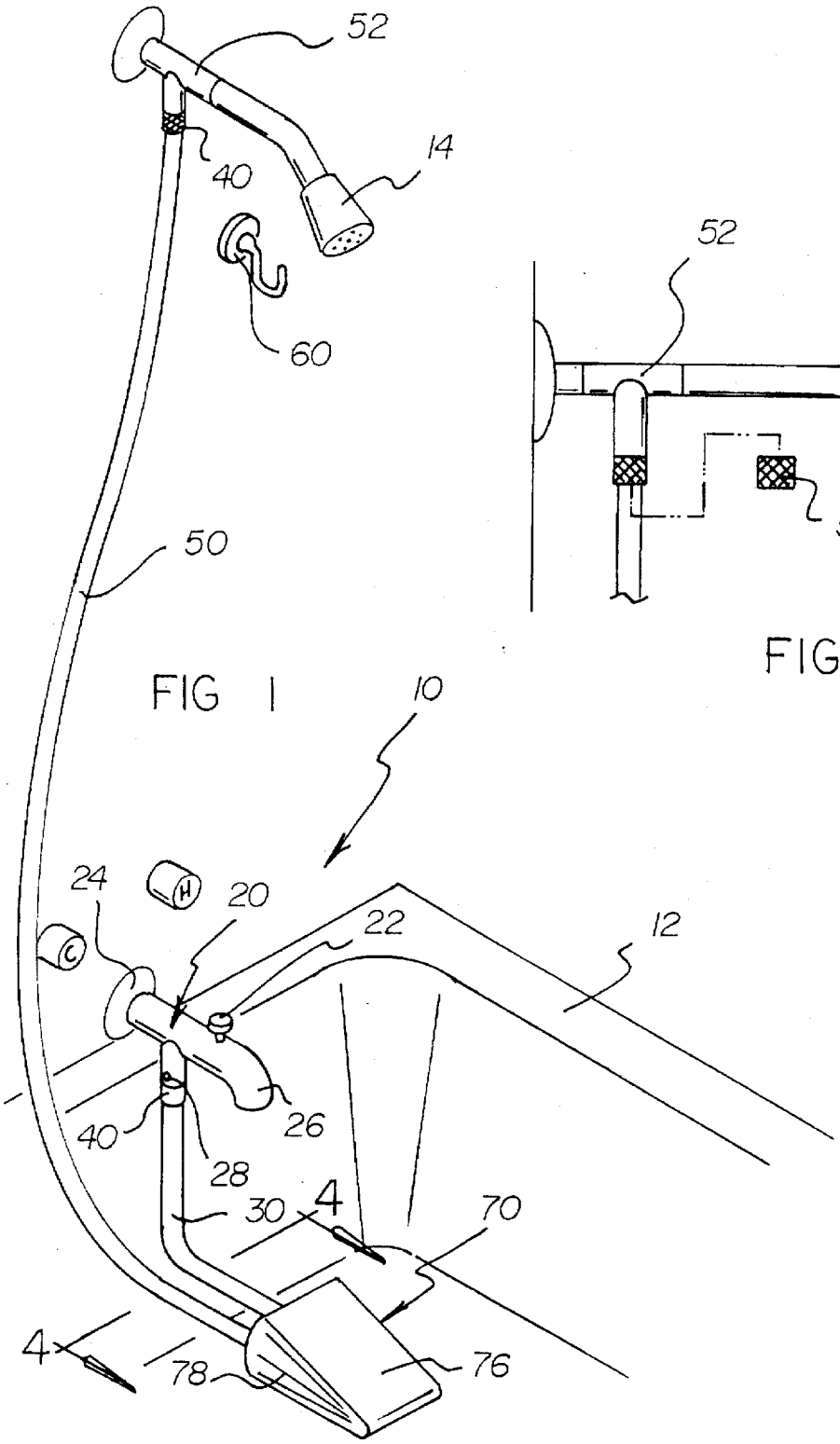
FIG. 1 is an upper side perspective view of a new Shower Water Conservation System according to the present invention.
Figure 2:
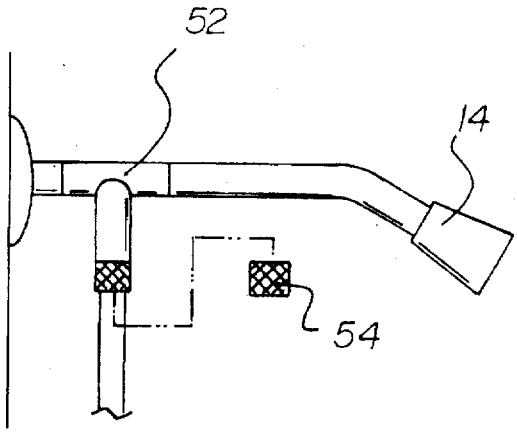
FIG. 2 is a side view of the present invention.
Figure 3:
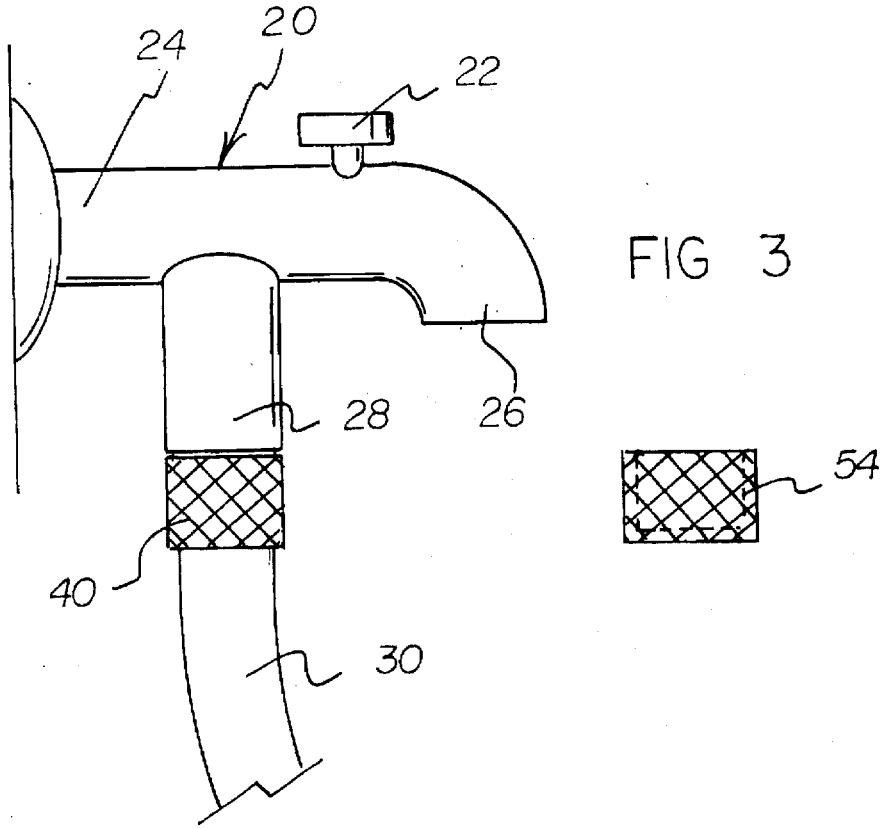
FIG. 3 is a side view of the T-spigot.

With reference now to the drawings, and in particular to FIGS. 1 through 6 thereof, a new Shower Water Conservation System embodying the principles and concepts of the present invention and generally designated by the reference numeral 10 will be described.

More specifically, it will be noted that the Shower Water Conservation System 10 comprises a T-spigot 20, a first flexible tube 30 coupled to the T-spigot 20, a water control valve matingly coupled with the first flexible tube 30 opposite of the T-spigot 20, a second flexible tube 50 matingly coupled to the control valve, and a T-coupler 52 matingly coupled to the second flexible tube 50 and a shower head 14.

As best illustrated in FIGS. 1 through 6, it can be shown that the T-spigot 20 has a first end 24, a second end 26 and a third end 28. The second has a shut-off valve 22. A first flexible tube 30 matingly couples to the third end 28 by a coupling means 40. A water control means 70 is matingly coupled to the end of the first flexible tube 30 opposite of the third end 28, whereby the water control means 70 is manually manipulated by a user to control water flow from the first flexible tube 30. The second flexible tube 50 is matingly coupled to the water control means 70 opposite of the first flexible tube 30. The T-coupler 52 is secured mesial a shower head 14 and a water supply pipe. The end of the second flexible tube 50 opposite of the water control means 70 is matingly coupled to the T-coupler 52 by the coupling means 40 to supply water to the shower head 14. A cap 54 is matingly coupled to the third end 28 and the T-coupler 52 when the invention is not in use, thereby preventing leakage of water during storage of the invention. A storage hook 60 is secured to an unnumbered wall of a bath tub 12 which supports the first flexible tube 30 and the second flexible tube 50.

Figure 4:
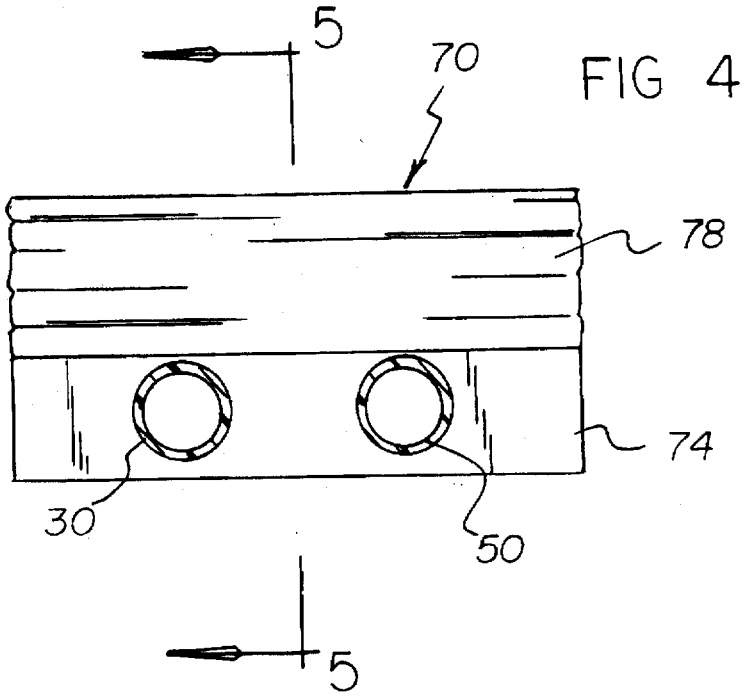
FIG. 4 is a cross sectional view taken along line 4—4 of FIG. 1.
Figure 5:
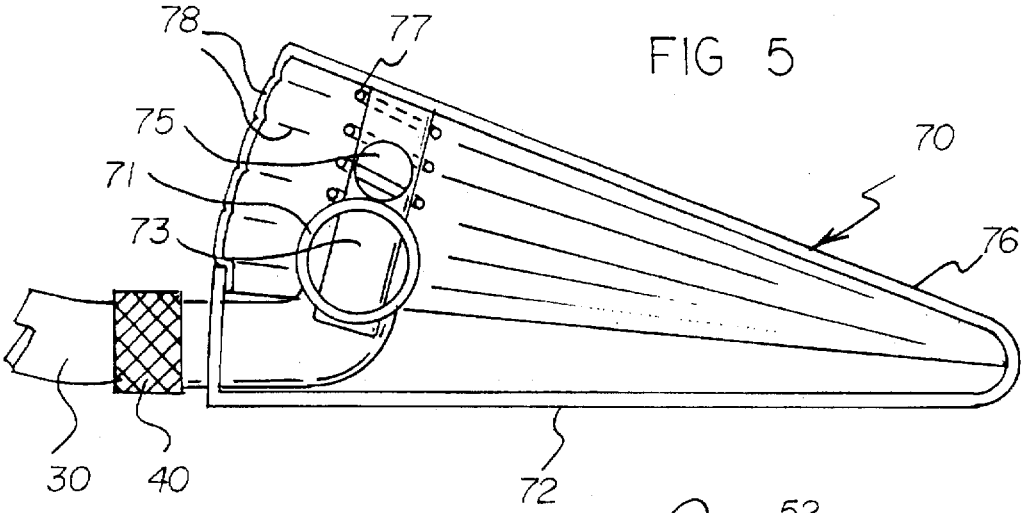
FIG. 5 is a cross sectional view taken along line 5—5 of FIG. 4.
Figure 6:
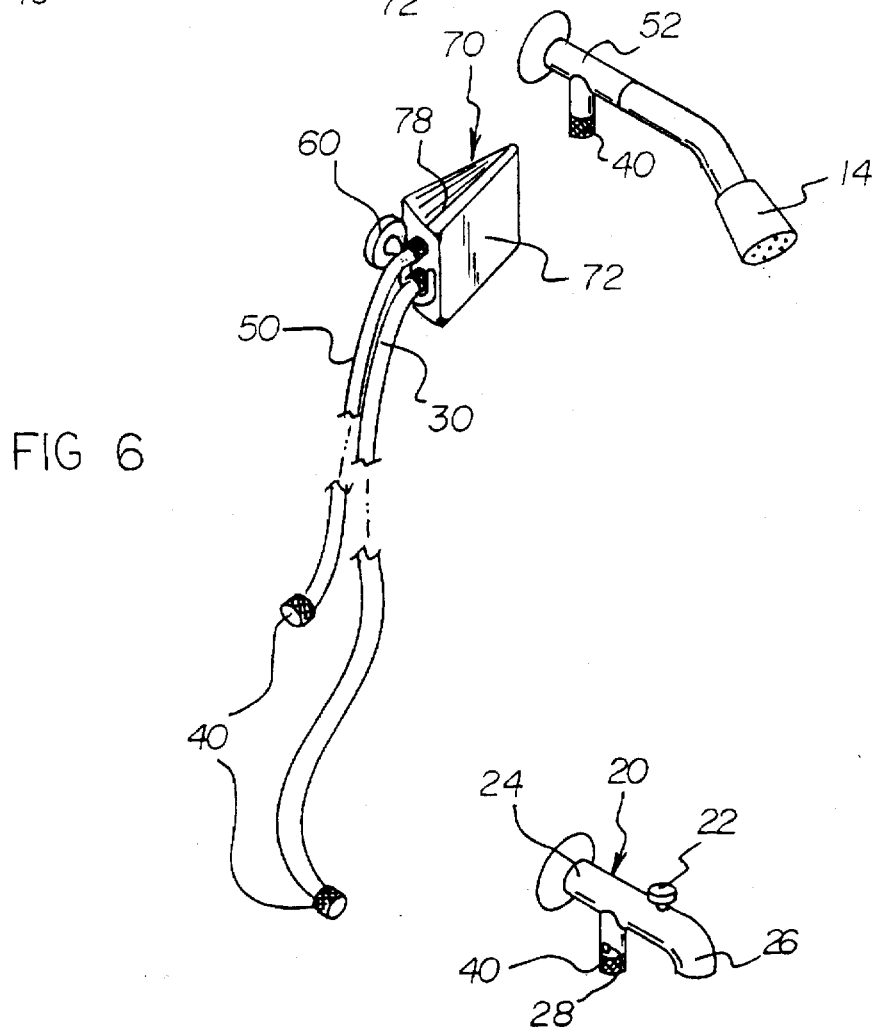
FIG. 6 is an upper perspective view of the present invention disassembled.

As shown in FIGS. 1 and 3 through 6, the water control means 70 has a base plate 72. A first member 74 is secured to an end of the base plate 72 extending upwardly. The first flexible tube 30 and the second flexible tube 50 project through the first member 74 as best shown in FIG. 4 of the drawings. A top plate 76 is pivotally secured to the base plate 72 opposite of the first member 74 as best shown in FIG. 5 of the drawings. A tube member 71 is coupled between the first flexible tube 30 and the second flexible tube 50 as shown in FIG. 5. The tube member 71 has an unnumbered aperture extending radially and concentrically positioned between the first flexible tube 30 and the second flexible tube 50. A plunger 73 slidably projects through the aperture and is secured to said top plate 76 at the opposite end. The plunger 73 has a water passage 75 transversely to the longitudinal axis secured at one end to the top plate 76. When the water passage 75 aligns with the axis of the tube member 71 water from the first flexible tube 30 flows through the tube member 71 into the second flexible tube 50. A compression spring 77 is positioned mesial the base plate 72 and the top plate 76 thereby springably separating the base plate 72 and the top plate 76. A resilient cover 78 is preferably secured between the top plate 76 and the base plate 72, thereby preventing debris from collecting within the water control means 70.

In use, the user controls the output of water through the shower head 14 by pressing the top plate 76 downwardly to achieve the desired water pressure. When the user doesn't require any water, the user releases the pressure upon the top plate 76 whereby the compression spring 77 separates the top plate 76 from the base plate 72 resulting in the water passage 75 within the plunger 73 to become disaligned with the axis of the tube member 71 thereby stopping water flow through the tube member 71.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Shower Water Conservation System comprising:

a T-spigot having a first end adapted to be coupled to a water supply pipe, a second end and a third end;

said second end having a shut-off valve;

a first flexible tube removably coupled at one end thereof to said third end;

a water control means matingly coupled to the opposite end of said first flexible tube, where by said water control means is positioned and adapted to be manually manipulated by a foot of the user to control water flow from said first flexible tube;

a second flexible tube matingly coupled at one end thereof to said water control means opposite of said first flexible tube; and a T-coupler adapted to be secured mesial a shower head and a water supply pipe, where the opposite end of said second flexible tube is removably coupled to said T-coupler to supply water to said shower head.

2. The Shower Water Conservation System of claim 1, wherein said water control means comprises:

a base plate;

a first member secured to an end of said base plate extending upwardly, where said respective ends of said first flexible tube and said second flexible tube project through said first member;

a top plate pivotally secured to said base plate opposite of said first member;

a tube member coupled between said ends of said first flexible tube and said second flexible tube;

said tube member having an aperture extending therethrough and positioned between said first flexible tube and said second flexible tube;

a plunger slidably projecting through said aperture;

said plunger including a water passage therethrough, such that where when said water passage aligns with the aperture of said tube member water from said first flexible tube flows through said tube member into said second flexible tube; and a compression spring positioned between said base plate and said top plate thereby separating said base plate and said top plate.

3. The Shower Water Conservation System of claim 2, wherein a resilient cover is secured between said top plate and said base plate, thereby preventing debris from collecting within said water control means.

4. A Shower Water Conservation System comprising:

a T-spigot having a first end adapted to be coupled to a water supply pipe, a second end and a third end;

said second end having a shut-off valve;

a first flexible tube removably coupled at one end thereof to said third end by a coupling means;

a water control means matingly coupled to the opposite end of said first flexible tube, where by said water control means is positioned and adapted to be manually manipulated by a foot of the user to control water flow from said first flexible tube;

a second flexible tube matingly coupled at one end thereof to said water control means opposite of said first flexible tube;

a T-coupler adapted to be secured mesial a shower head and a water supply pipe, where the opposite end of said second flexible tube is removably coupled to said T-coupler by said coupling means to supply water to said shower head;

a pair of caps for matingly coupling with said third end and said T-coupler when said first and second flexible tubes are removed therefrom, to prevent leakage of water; and, a storage hook adapted to be secured to a wall of a bath tub for supporting said first flexible tube and said second flexible tube.

5. The Shower Water Conservation System of claim 4, wherein said water control means comprises:

a base plate;

a first member secured to an end of said base plate extending upwardly, where said respective ends of said first flexible tube and said second flexible tube project through said first member;

a top plate pivotally secured to said base plate opposite of said first member;

a tube member coupled between said ends of said first flexible tube and said second flexible tube;

said tube member having an aperture extending therethrough and positioned between said first flexible tube and said second flexible tube;

a plunger slidably projecting through said aperture;

said plunger including a water passage therethrough, such that where when said water passage aligns with the aperture of said tube member water from said first flexible tube flows through said tube member into said second flexible tube; and a compression spring positioned between said base plate and said top plate thereby separating said base plate and said top plate.

6. The Shower Water Conservation System of claim 5, wherein a resilient cover is secured between said top plate and said base plate, thereby preventing debris from collecting within said water control means.

* * * * *